United States Patent [19]

Jenni

[11] Patent Number: 4,603,646

[45] Date of Patent: Aug. 5, 1986

[54] EMBROIDERY MACHINE FRAMEWORK

[75] Inventor: Karl Jenni, Hohenems, Austria

[73] Assignee: Aktiengesellschaft Adolph Saurer, Arbon, Switzerland

[21] Appl. No.: 660,807

[22] Filed: Oct. 15, 1984

[30] Foreign Application Priority Data

Oct. 20, 1983 [AT] Austria ..... 3735/83

[51] Int. Cl.[4] ..... D05C 9/14

[52] U.S. Cl. ..... 112/90

[58] Field of Search ..... 112/121.14, 90, 86

[56] References Cited

U.S. PATENT DOCUMENTS

| | | | |
|---|---|---|---|
| 2,760,454 | 8/1956 | Lambach | 112/90 |
| 3,161,165 | 12/1964 | Comerio | 112/90 |
| 3,468,268 | 9/1969 | Rolauffs | 112/90 X |
| 3,991,691 | 11/1976 | Bolldorf | 112/90 X |

*Primary Examiner*—Werner H. Schroeder
*Assistant Examiner*—Andrew M. Falik
*Attorney, Agent, or Firm*—Werner W. Kleeman

[57] ABSTRACT

A embroidery framework is displaceable in vertical and horizontal directions by related drives and contains a circumferentially closed embroidery frame. This embroidery frame is supported at supports which are vertically displaceable by a vertical drive of the related drives. A side member of the embroidery frame is held in a vertically extending guide rail for displacement in a vertical direction. From the vertically extending guide rail there projects a horizontal bracket which conjointly with such guide rail forms a T-shaped constructional unit resistant to bending. This constructional unit is guided in horizontal direction at a stationary machine stand. The horizontal drive of the related drives act upon the constructional unit comprising the guide rail and the bracket.

14 Claims, 4 Drawing Figures

EMBROIDERY MACHINE FRAMEWORK

BACKGROUND OF THE INVENTION

The present invention relates to a new and improved construction of an embroidery machine.

In its more particular aspects, the present invention relates specifically to a new and improved construction of an embroidery machine comprising an embroidery framework which is displaceable essentially both in vertical and horizontal directions by related drive means defining respective vertical and horizontal drives. The embroidery framework contains a circumferentially closed embroidery frame which is supported at supports which are substantially vertically displaceable by the vertical drive. The horizontal drive acts upon at least one side member of the embroidery frame.

Due to the great length of embroidery machines and thus of the embroidery framework there repeatedly result problems with respect to the dimensional stability or rigidity of the embroidery framework, particularly since the relatively short-stroke displacing movements of the embroidery framework should have the same magnitude at each location of the embroidery framework in order to prevent inaccurate or distorted embroidery patterns or designs.

Embroidery frameworks and more particularly such embroidery frameworks of great length and provided with cloth beams which are arranged above each other in a plural number of decks, have a large mass which must be displaced with rapidly successive displacing movements during an embroidering operation. There result therefrom in hitherto known embroidery machines distortion phenomena or warping in the plane of the embroidery framework, particularly so-called parallelogram displacements, that is angular displacements at the corner or apex connections of the circumferentially closed embroidery frame. Such distortion phenomena or warping, above all, occur because the element which transmits the horizontal displacement to the framework and which usually comprises one or two horizontally and parallelly extending tooth racks or the like, always remains at the same level with respect to the stationary machine stand, while the embroidery framework, contrary thereto, is located higher or lower depending on the progress of the embroidering operation. Thus, the point of engagement for initiating the horizontal displacement is continuously displaced relative to the mass center of the embroidery framework or, respectively, relative to the upper and lower horizontal frame members which transmit the horizontal displacement. Due to this effect and depending on the position of the embroidery framework, smaller or greater angular dislocations occur. The parallel arrangement of two elements, for example, tooth racks or the like, one above the other for initiating the horizontal drive at one side member of the embroidery frame, may possibly somewhat diminish the disadvantages of the aforementioned parallelogram displacements but cannot totally remove such disadvantages.

It may be obvious to increase the dimensional stability or rigidity of the embroidery frame by substantially reinforcing the corner or apex connections thereof. Such measures, however, would necessarily result in a further increase of the weight or mass of the embroidery framework. Such weight or mass increase, in turn, would result in unbearable loads on the drive means, particularly at the presently desired high embroidering speeds.

SUMMARY OF THE INVENTION

Therefore, with the foregoing in mind, it is a primary object of the present invention to provide a new and improved construction of an embroidery machine which is not afflicted with the aforementioned drawbacks and limitations of the prior art constructions heretofore discussed.

Another and more specific object of the present invention is directed to the provision of a new and improved construction of an embroidery machine in which distortion phenomena or angular dislocations with respect to the plane of the embroidery framework are practically prevented also at high embroidering speeds and when using embroidery frameworks of great length and height.

A still further important object of the present invention is directed to the provision of a new and improved construction of an embroidery machine which enables the selection of a lighter mode of construction for the embroidery framework and yet is practically devoid of any distortion phenomena or angular dislocations.

Now in order to implement these and still further objects of the invention, which will become more readily apparent as the description proceeds, the embroidery machine of the present development is manifested by the features that, at least one side member of the embroidery frame is held in at least one guide rail for displacement in essentially vertical direction, at least one substantially horizontal bracket projects from such essentially vertically extending guide rail, the substantially horizontal bracket conjointly with the guide rail forms at least one substantially T-shaped constructional unit resistant to bending and which is guided in essentially horizontal direction at a stationary machine frame, and the horizontal drive acts upon the at least one constructional unit comprising the guide rail and the at least one substantially horizontal bracket.

Due to such inventive measures there is obtained a horizontal displacement which practically is effective over the entire height or vertical extent of the embroidery framework and at a rigidity which makes impossible any distortion or warping. The action of the displacing forces for the horizontal displacement practically occurs over the entire height of the embroidery framework and substantially uniformly upon the side member independent of the momentary elevational position of the embroidery framework. Consequently, there are not required any specific reinforcements of the corner or apex connections of the embroidery frame which contributes to a saving in weight. The substantially T-shaped constructional unit formed by the vertically extending guide rail and the horizontal bracket, is resistant to bending and insures rigidity of the embroidery framework in the plane thereof against distortion, and thus, a precise maintenance of the angles at the corners or apices of the embroidery frame. It is of particular essence in this structure that this constructional unit which reinforces the embroidery framework is not entrained or conjointly moved with the substantially vertical displacement of the embroidery framework, so that there is achieved thereby a further great saving of weight, particularly in this direction of movement.

The inventive measures not only permit substantially reducing the dimension of a high-weight crossbeam or traverse, which constitutes a support for the embroidery frame, but it has been found that such crossbeam or traverse could be totally omitted because short guide members arranged in a spaced relationship are sufficient to effect the vertical displacement of the embroidery framework.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
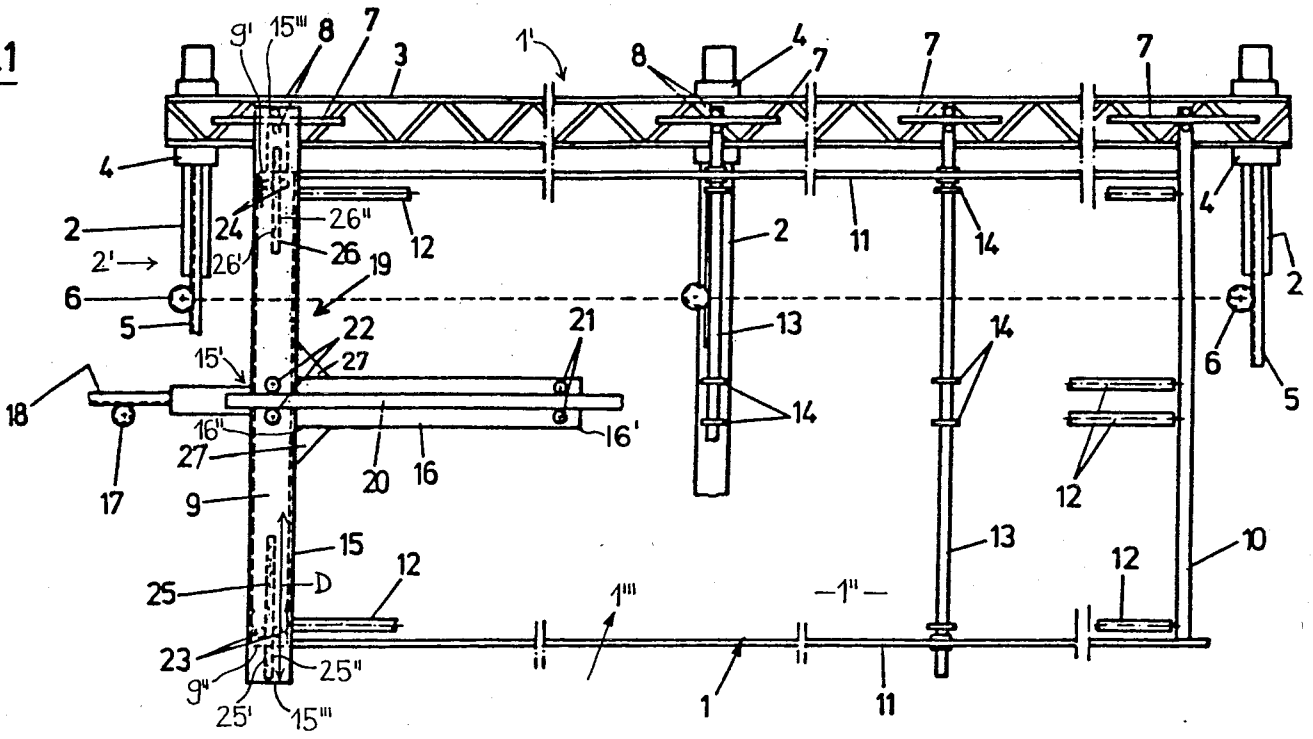
FIG. 1 is a simplified front view of a first embodiment of the inventive embroidery machine comprising an embroidery framework with two embroidering decks or levels and with drive means for horizontal and vertical displacements but without the actual embroidering implements or elements.

Describing now the drawings, it is to be understood that only enough of the construction of the embroidery machine has been shown as needed for those skilled in the art to readily understand the underlying principles and concepts of the present development, while simplifying the showing of the drawings. Turning attention now specifically to FIG. 1, there has been schematically illustrated in front view a first embodiment of the inventive embroidery machine which essentially comprises a stationary machine stand 2' and a substantially horizontally and vertically displaceable embroidery framework 1'.

There have only been conveniently illustrated sections of the stationary machine stand 2', namely the approximately vertically extending support members 2. In the region of the upper end of such support members 2 there is held a predetermined number of substantially vertically displaceable supports which, in the illustrated embodiment, is constituted by a crossbeam or traverse 3 which is substantially vertically displaceable by vertical drive means or drive 5, 6 to be described in more detail hereinafter. The crossbeam or traverse 3 forms the support for the embroidery framework 1' which likewise will be described in greater detail hereinafter.

The vertical drive means or drive 5, 6 comprise, for instance, tooth racks 5 which are in engagement with pinions 6. The tooth racks 5 act upon support members 4 which carry the crossbeam or traverse 3 defining a support. Depending on the required substantially vertical displacement of the embroidery framework 1', the tooth rack 5 is substantially upwardly or downwardly displaced by an appropriate rotational movement of the pinion 6, so that the support defined by the crossbeam or traverse 3 is accordingly raised or lowered.

There are mounted guide ledges 7 at the crossbeam or traverse 3 and the circumferentially closed embroidery frame 1 is suspended at the guide ledges 7 by means of guide or guiding rolls 8 or the like. There is arranged one related pair of guide rolls 8 on both sides of each guide ledge 7. There is thus insured an essentially vertical displacement of the embroidery frame 1 and such essentially vertical displacement is realized in a simple manner.

The embroidery frame 1 comprises at least one side member, in the illustrated example two side members 9 and 10, as well as upper and lower lengthwise extending rails 11. Cloth beams 12 are mounted in conventional manner at the side members 9, 10. Further rails 13 may be arranged to extend in substantially vertical direction between the side members 9, 10 and such further rails 13 may comprise adjustable supports 14 for the cloth beams 12. Such rails 13, if desired, may act upon related guide ledges 7 in addition to the primary suspensions described hereinbefore.

According to the present invention, the side member 9 of the embroidery frame 1 is held in a substantially vertically extending guide rail 15 for displacement in essentially vertical direction. An essentially horizontal bracket 16 projects from such substantially vertically extending guide rail 15 and is guided at the stationary machine stand 2' in essentially horizontal direction. The horizontal drive means or drive 17, 18 for the embroidery frame 1 comprises a pinion 17 and a tooth rack 18 and acts upon a constructional unit 19 which is formed by the substantially vertically extending guide rail 15 and the substantially horizontal bracket 16. The vertically extending guide rail 15 and the horizontal bracket 16 are interconnected in such a manner that they conjointly form a substantially T-shaped constructional unit 19 which is resistant to bending. It is achieved thereby that the forces for the horizontal displacement of the embroidery frame 1 are substantially uniformly transmitted over substantially the entire height of the embroidery framework 1', so that there can not arise any distortion or warping of the embroidery framework 1'. It is essential, specifically for fine embroidery patterns, that precisely the same movement occurs at each location of the plane 1'' defined by the embroidery framework 1'.

The particular manner of guiding the substantially horizontal bracket 16 and the substantially vertically extending guide rail 15 rigidly connected thereto insure that practically there does not occur any unilateral load on the embroidery frame 1.

Preferably, and for achieving optimum guidance, the length of the substantially horizontal bracket 16 is greater than half the length of the vertically extending guide rail 15. Advantageously, the length of the horizontal bracket 16 is even approximately one-and-a-half times greater than half the length of the vertically extending guide rail 15. It will be self-evident to provide for a sufficient corner or apex reinforcement at the connection between the horizontal bracket 16 and the vertically extending guide rail 15, for example, by means of reinforcement plates as indicated at 27 in FIG. 1.

A substantially horizontal stationary rail or rail member 20 is arranged for guiding the substantially horizontal bracket 16 at the stationary machine stand 2' and such horizontal rail 20 is fixedly connected to the stationary machine stand 2'. In the region of the free or cantilevered end 16' of the substantially horizontal bracket 16 and also in the region 16'' thereof which is associated with the substantially vertically extending guide rail 15 there are at least provided a first pair of guide rolls 27 at the free or cantilevered end 16' of the horizontal bracket 16 and a second pair of guide rolls 22 in the region of the substantially vertically extending guide rail 15 and each pair of the guide rolls 21 ad 22 is supported on both sides of the horizontal rail 20. Due to the relatively great distance between the two pairs of guide rolls 21, 22 there is obtained proper rigidity during the transmission of the horizontal movement to the embroidery frame 1.

Figure 2:
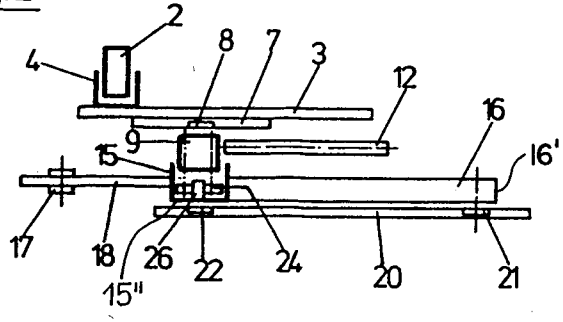
FIG. 2 is a top plan view of the arrangement of the embroidery machine shown in FIG. 1 in the region of a substantially T-shaped constructional unit resistant to bending.

In the embodiment illustrated in FIGS. 1 and 2 the horizontal drive means or drive 17, 18 comprising the pinion 17 and the tooth rack 18 acts upon the substantially vertically extending guide rail 15 approximately at the center 15' of its length, i.e. in the region of the substantially horizontal bracket 16 which is associated with the substantially vertically extending guide rail 15. Any tilting or canting is additionally precluded by this arrangement. In this first embodiment the horizontal drive means 17, 18 acts upon the substantially vertically extending guide rail 15 at a location which is opposite the substantially horizontal bracket 16. This horizontal bracket 16 thus can be aligned substantially parallel to an embroidery framework plane 1'' and protrudes into a region 1''' defined by the embroidery framework 1'. Generally, there is sufficient space in this region 1''' of the embroidery framework 1' to accommodate the structure described hereinbefore, so that this structure does not represent an enlargement of the entire structure of the embroidery machine.

Figure 3:
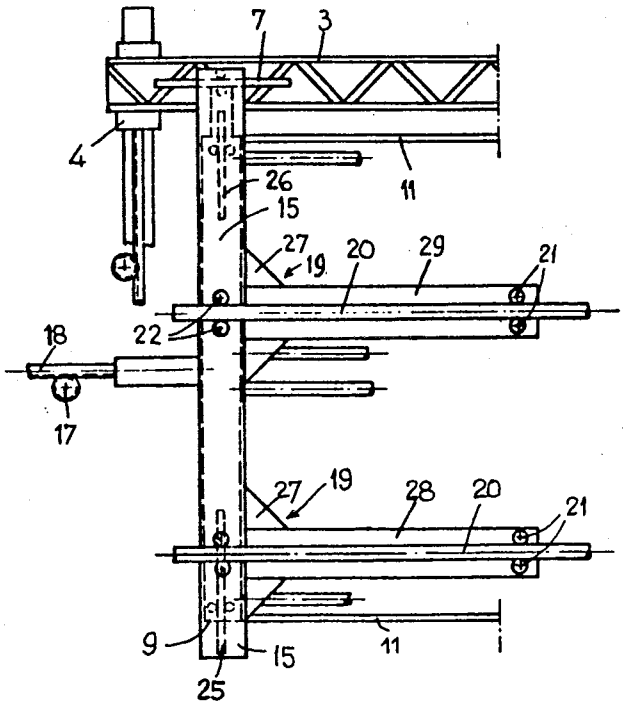
FIG. 3 is a simplified front view of a second embodiment of the inventive embroidery machine and corresponds to the left-hand portion of the arrangement shown in FIG. 1.

Such arrangement as described hereinbefore, on the other hand, contains a horizontal bracket 16 projecting from approximately the center 15' of the vertically extending guide rail 15 and thus projects into the embroidery framework 1' approximately at the center of the height thereof and may impair or obstruct manipulations at the embroidering implements or tools. A dual arrangement, constituting a second embodiment of the inventive apparatus, is illustrated in FIG. 3 and is capable of removing the aforementioned disadvantage. As shown in FIG. 3, there are provided in this embodiment two substantially horizontal brackets designated by the reference characters 28 and 29 and associated substantially horizontal guide rails 20 with pairs of guide rolls 21 and 22 as described hereinbefore with reference to FIG. 1. These two horizontal brackets 28 and 29 extend outside the region of the embroidering implements or tools and replace the horizontal bracket 16 which projects approximately from the center 15' of the substantially vertically extending guide rail 15. The two horizontal brackets 28 and 29 extend substantially parallel to each other in a spaced relationship and project from the substantially vertically extending guide rail 15 opposite to the horizontal drive means or drive 17 and 18. Each of the horizontal brackets 28 and 29 again forms a substantially T-shaped constructional unit 19 which is resistant to bending and in which the horizontal brackets 28 and 29 and the vertically extending guide rail 15 are preferably interconnected in a manner resistant to bending by means of reinforcing plates 27. Such arrangement of the two horizontal brackets 28 and 29 further permits the guiding means for substantially horizontally guiding the horizontal brackets 28 and 29, namely the related stationary horizontal rails or rail members 20, to be directly mounted at already existent horizontal supporting beams of the machine stand 2'. Except for this duplication of horizontal brackets the construction of the embroidery machine shown in FIG. 3 corresponds to the construction of the first embodiment shown in FIGS. 1 and 2 with respect to all members or parts which are designated by the same reference characters.

The side member 9 of the embroidery frame 1 is supported at the interior side 15'' of the substantially vertically extending guide rail 15 by means of support rolls 23 and 24. The side member 9 defines an upper end or end region 9' and a lower end or end region 9'' and related pairs of support rolls 23, 24 are arranged at such ends or end regions 9' and 9''. Due to such arrangement there occurs a transmission of the forces for horizontal displacement of the embroidery framework 1' at the corners or apices thereof, so that there is obtained an exactly rectilinear displacement of the embroidery framework 1' without there arising any angular displacement, that is distortion or warping. In the illustrated exemplary embodiment this problem is solved in such a manner that the substantially vertically extending guide rail 15 is structured with a substantially U-shaped profile having upper and lower end regions 15''' into which related profiled rails 25, 26 are inserted which comprise related guide surfaces 25', 25'' and 26', 26''. The pairs of support rolls 23, 24 act upon such guide surfaces 25', 25'' and 26', 26'', respectively. In the end regions 15''' of the substantially vertically extending guide rail 15 there are defined related displacement paths D of a predetermined length and the profiled rails 25, 26 substantially extend over the related displacement paths D. If desired, there can also be arranged in an analogous manner pairs of support rollers in the intermediate region of the substantially vertically extending guide rail 15.

It will be self-evident that in this structure there are also still provided suitabe alignment rolls (not shown) with substantially transversely extending rotational axes in order to insure exact alignment of the embroidery framework 1' in vertical direction. The precise arrangement of the pairs of guide rolls 23, 24 and of the related alignment rolls can be accomplished in various constructional manners and for this purpose there can also be utilized a specific design or structure of a profile of the side member 9. In the top plan view shown in FIG. 2 there is illustrated merely a hollow profile of the side member 9. It will be obvious that in this case there can be provided related prolonged lateral flanges and other members in order to receive the pairs of support rolls 23, 24. However, such constructional measures can be resorted to depending upon the momentarily encountered requirements.

It is essential and important that a substantially vertically extending guide rail 15 is provided for one side member 9 of the embroidery framework 1' and that a substantially rectangularly projecting horizontal bracket 16 engages the vertically extending guide rail 15 in a bending-resistant manner and is guided in substantially horizontal direction at the stationary machine stand 2'. As a result, there is provided a substantially T-shaped constructional unit which insures the entire rigidity of the embroidery framework 1' against distortion in the plane thereof and thus a precise maintenance of the angles thereof. The lengthwise extending rails 11 of the embroidery framework 1' can be dimensioned correspondingly lighter, so that a further reduction in weight can be achieved.

In the illustrated exemplary embodiments the embroidery framework 1' is suspended from the support defined by the crossbeam or traverse 3 by means of the side members 9, 10 and intermediately located rails 13. It will be understood that there is also the possibility of arranging each of the guide ledges 7 in the regions of the related vertical support members 2 instead of mounting the same at the crossbeam or traverse 3, and thus, of directly connecting such guide ledges 7 to the support members 4. Due to the inventive construction there is then no longer required a continuous crossbeam or traverse 3 and then it is sufficient to utilize appropriately reinforced guide ledges 7 as the initlly mentioned predetermined number of supports. Such guide ledges 7 are then vertically displaceable by the vertical drive means or drive 5, 6 for vertical displacement which are arranged at each one of the support members 2.

There will thus result a further weight reduction since in such case the material of the crossbeam or traverse 3 can be omitted. Consequently, there results a still lower weight load during the operation of the embroidery machine, particularly for vertical displacement, so that the operating speed of embroidery machines which are equipped in this manner can still be further increased.

There is the further added advantage that the omission of the crossbeam or traverse 3, in comparison to embroidery machines containing such crossbeam or traverse 3, permits a reduction in the overall machine height at comparable sizes of the embroidery framework 1' and at comparable vertical displacements of such embroidery framework 1'. The vertical space requirement thus can be reduced by up to 10% in comparison to comparable embroidery machines containing the crossbeam or traverse 3.

For the reasons of illustrative clarity the lateral guidance of the embroidery framework 1' is not shown in the drawings. However, such lateral guiding is self-evident because the embroidery framework 1' always has to be aligned to the essentially vertical direction. Since, however, there hardly occur loads on the embroidery frame 1 which are directed transversely to the plane of the embroidery frame 1, a more detailed discussion thereof can be dispensed with at this place. The embroidery frame 1 in the inventive embroidery machine should be dimensioned only with such a strength as required for the transmission of horizontal forces and for retaining the cloth beams 12. By virtue of the inventive measures also the exterior right-hand side member 10 shown in FIG. 1, which thus is remote from the known automatic embroidery drive and control unit and also from the drive means and which is not stabilized or reinforced by a substantially vertically extending guide rail, can also be dimensioned comparatively lightweight.

It is essential and important that there are always maintained, due to the inventive measures, accurate angles in the embroidery frame 1, so that the horizontal members are substantially rectangularly aligned to the vertical members at all times. Thus, there cannot result any distortion or warping within the plane 1'' of the embroidery framework 1'. This is accomplished by the substantially vertically extending guide rail 15 and the substantially horizontal bracket 16 which is mounted thereat in combination with the stationary machine stand 2'. The embroidery frame 1 thus has sufficient strength on the side of the horizontal drive and control unit. The side member 10 on the side remote from the horizontal drive and control unit can then be dimensioned to be very small.

In the case of particularly long embroidery machines it would be quite obvious and conceivable to associate constructional units 19 of the type as shown in FIGS. 1 or 3 with each one of the two side members 9 and 10, particularly in embroidery machines having horizontal drive means or drives on both sides. However, tests have shown that the arrangement of the constructional unit 19 on one side of the embroidery framework 1' is sufficient throughout even in embroidery machines of great structural length.

When using the hitherto conventional drive means, the vertical support member 2 which is shown on the full left in the drawings should be arranged laterally outside the left end of the embroidery framework 1', that is laterally adjacent the substantially vertically extending guide rail 15. This is required because the driving action at the tooth rack 5 must be mechanically transmitted in a rectilinear manner from the automatic control and drive unit of the embroidery machine. The construction described further hereinbefore in which the guide ledges 7 are directly mounted at the vertical support members 2, therefore, is particularly and preferably employed when, for example, drive means comprising stepping motors, hydraulic drive means or the like are provided instead of the illustrated and previously mentioned drive means 5, 6 containing tooth racks 5 or 18 and related pinions 6, 17 for the horizontal and vertical displacements of the embroidery framework 1'. The support members 2, then, can be readily positionally shifted to the central region with respect to the horizontal displacement of the embroidery framework 1' and thus of the substantially vertically extending guide rail 15, so that the guide ledges 7 can be directly mounted at the support members 4 which slide at the vertical support members 2.

Figure 4:
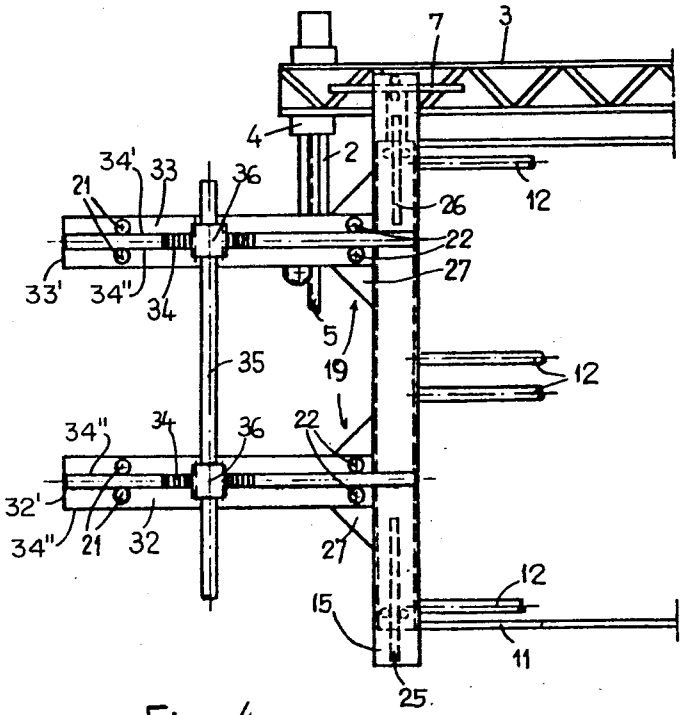
FIG. 4 is a simplified front view, corresponding to the left-hand portion of FIG. 1, and showing a third embodiment of the inventive embroidery machine.

The third embodiment of the inventive apparatus illustrated in FIG. 4 is a modification by means of which already existent embroidery machines can be readily equipped in accordance with the invention. In such conventional embroidery machines the horizontal drive is effected by two substantially horizontal tooth racks which act upon the embroidery frame 1.

The embodiment illustrated in FIG. 4 differs from the embodiments illustrated in FIGS. 1 to 3 in that, in this embodiment, two substantially horizontal brackets or bracket members 32, 33, which are connected to the substantially vertically extending guide rail 15 in a bending-resistant manner, do not protrude into the embroidery frame 1 but project substantially in the plane 1'' of the embroidery frame 1 and substantially horizontally away from the embroidery framework 1' into the region of the conventional vertical drive shaft 35 containing the drive pinions 36 for the horizontal drive. The pinions 36 mesh or engage with related tooth rack profiles 34 which replace the usual tooth racks of conventional drive means and each of which is fixedly connected with the associated substantially horizontal bracket 32, 33 and eventually with the substantially vertically extending guide rail 15 and thus forms a component of the inventive bending-resistant constructional unit 19. In principle, there are thus reinforced in this embodiment the tooth racks which are already present in conventional embroidery machines and are modified or extended to form substantially rigid horizontal brackets with a tooth rack profile mounted or provided thereat. Such horizontal brackets 32, 33 are then, in the inventive manner, bending-resistantly connected with the substantially vertically extending guide rail 15 which holds the side member 9 of the embroidery frame 1.

The substantially horizontal brackets 32, 33 are guided at the stationary machine stand 2' in a manner which is similar to the embodiment shown in FIG. 1. However, in the present case, the pairs of guide rolls 21, 22 for guiding the horizontal brackets 32, 33 are stationarily mounted at the machine stand 2'. One pair of guide rolls 21 is respectively supported at both sides 34' and 34'' of the tooth rack profile 34 in the region of the free ends 32' and 33' of the horizontal brackets 32 and 33. The other pairs of guide rolls 22 are supported in the same manner in the region of the substantially vertically extending guide rail 15.

The constructional effort or expense for accomplishing the inventive measures is extremely modest, there is required a substantially smaller amount of structural materials and, in accordance therewith, there are also reduced the service and maintenance operations although the embroidery machine constructed in accordance with the invention can be operated at a substantially higher speed.

While there are shown and described present preferred embodiments of the invention, it is to be distinctly understood that the invention is not limited thereto, but may be otherwise variously embodied and practiced within the scope of the following claims. Accordingly,

What I claim is:

1. An embroidery machine comprising:

an embroidery framework;

at least one support for supporting the embroidery framework;

said embroidery framework containing a circumferentially closed embroidery frame supported at said at least one support;

said embroidery frame containing at least one side member;

vertical drive means for substantially vertically displacing said embroidery framework;

said at least one support being substantially vertically displaceable by said vertical drive means;

horizontal drive means for substantially horizontally displacing said embroidery frame;

at least one substantially vertically extending guide rail at which said at least one side member of said embroidery frame is guided for displacement in essentially vertical direction;

at least one substantially horizontal bracket projecting from said at least one substantially vertically extending guide rail;

said at least one substantially horizontal bracket and said at least one substantially vertically extending guide rail conjointly forming at least one substantially T-shaped constructional unit essentially resistant to bending;

a stationary machine stand;

said at least one substantially horizontal bracket being substantially horizontally guided at said stationary machine stand; and said horizontal drive means acting upon said at least one constructional unit comprising said at least one substantially horizontal bracket and said at least one substantially vertically extending guide rail.

2. The embroidery machine as defined in claim 1, wherein:

said at least one substantially horizontal bracket and said at least one substantially vertically extending guide rail each have a predetermined length; and said predetermined length of said at least one substantially horizontal bracket is greater than half of said predetermined length of said substantially vertically extending guide rail.

3. The embroidery machine as defined in claim 2, wherein:

said predetermined length of said at least one substantially horizontal bracket is equal to approximately 1.5 times said half of said predetermined length of said substantially vertically extending guide rail.

4. The embroidery machine as defined in claim 1, wherein:

said at least one substantially horizontal bracket comprises an additional substantially horizontal bracket and thus constitutes two substantially horizontal brackets;

said two substantially horizontal brackets projecting from said at least one substantially vertically extending guide rail substantially parallel to each other in a spaced relationship; and each one of said two substantially horizontal brackets being connected with said at least one substantially vertically extending guide rail in a manner essentially resistant to bending.

5. The embroidery machine as defined in claim 1, further including:

at least one substantially horizontal stationary rail operatively associated with said at least one substantially horizontal bracket in order to guide the same at said stationary machine stand;

said at least one substantially horizontal bracket comprising a free end and a region associated with said substantially vertically extending guide rail;

a predetermined number of guide rolls supported at said at least one substantially horizontal stationary rail on both sides thereof; and at least a first pair of said predetermined number of guide rolls being arranged in the region of said free end of said at least one substantially horizontal bracket and at least one second pair of said predetermined number of guide rolls being arranged in said region of said at least one substantially horizontal bracket which is associated with said at least one substantially vertically extending guide rail.

6. The embroidery machine as defined in claim 1, wherein:

said embroidery framework defines a plane and further defines a region associated with said embroidery framework;

said at least one substantially horizontal bracket protruding into said region defined by said embroidery framework and being aligned substantially parallel to said plane defined by said embroidery framework; and said horizontal drive means acting upon said at least one substantially vertically extending guide rail at a location opposite to said at least one substantially horizontal bracket.

7. The embroidery machine as defined in claim 6, wherein:

said substantially vertically extending guide rail defines a predetermined length; and said horizontal drive means acting upon said substantially vertically extending guide rail at a location approximately at the center of its predetermined length.

8. The embroidery machine as defined in claim 1, further including:

at least one tooth rack profile provided at said at least one substantially horizontal bracket and defining two sides;

said horizontal drive means being in engagement with said at least one tooth rack profile;

said embroidery framework defining an embroidery framework plane;

said at least one substantially horizontal bracket projecting substantially horizontally from said at least one substantially vertically extending guide rail in a direction away from said embroidery framework and substantially in said plane defined thereby;

said at least one substantially horizontal bracket comprising a free end region;

at least one pair of guide rolls mounted at said stationary machine stand in the region of said free end region of said substantially horizontal bracket; and;

said at least one pair of guide rolls mounted at said stationary machine stand being supported at said two sides of said at least one tooth rack profile provided at said at least one substantially horizontal bracket.

9. The embroidery machine as defined in claim 1, further including:

a predetermined number of support rolls;

said at least one substantially vertically extending guide rail comprising an interior side;

said predetermined number of support rolls supporting said at least one side member of said embroidery frame at said interior side of said at least one substantially vertically extending guide rail;

said at least one side member defining an upper end region and a lower end region; and related pairs of said predetermined number of support rolls being arranged at least in said upper end region and in said lower end region of said at least one side member.

10. The embroidery machine as defined in claim 9, further including:

a predetermined number of profiled rails possessing guide surfaces for guiding thereat related pairs of said support rolls;

said at least one substantially vertically extending guide rail defining end regions;

related displacement paths each having a predetermined length for said related pairs of support rolls being defined at each one of said end regions of said at least one substantially vertically extending guide rail; and related ones of said profiled rails being inserted into said at least one substantially vertically extending guide rail at least in said end regions thereof and extending substantially over said predetermined length of said displacement paths for said pairs of support rolls.

11. The embroidery machine as defined in claim 10, wherein:

said at least one substantially vertically extending guide rail possesses a substantially U-shaped profile.

12. The embroidery machine as defined in claim 1, further including:

a predetermined number of guide ledges for guiding said embroidery frame during its substantially horizontal displacement under the action of said horizontal drive means upon said at least one substantially T-shaped constructional unit of said embroidery frame; and said predetermined number of guide ledges being mounted at said at least one support.

13. The embroidery machine as defined in claim 1, further including:

a predetermined number of guide ledges for guiding said embroidery frame during its substantially horizontal displacement under the action of said horizontal drive means upon said at least one substantially T-shaped constructional unit of said embroidery frame; and said predetermined number of guide ledges constituting said at least one support.

14. The embroidery machine as defined in claim 1, wherein:

said at least one substantially vertically extending guide rail is structured with a substantially U-shaped profile defining an interior side; and said at least one side member of said embroidery frame being guided at the interior side of said at least one vertically extending guide rail.

* * * * *

UNITED STATES PATENT AND TRADEMARK OFFICE

CERTIFICATE OF CORRECTION

PATENT NO. : 4,603,646

DATED : August 5, 1986

INVENTOR(S) : KARL JENNI

It is certified that error appears in the above-identified patent and that said Letters Patent are hereby corrected as shown below:

In the Abstract of the Disclosure, first word in the first line of such Abstract, please delete "A" and insert --An--

Signed and Sealed this

Tenth Day of February, 1987

*Attest:*

DONALD J. QUIGG

*Commissioner of Patents and Trademarks*

*Attesting Officer*